US011407024B2

(12) United States Patent
Lemonnier

(10) Patent No.: US 11,407,024 B2
(45) Date of Patent: Aug. 9, 2022

(54) PORTABLE TOOL HAVING A REMOVABLE HEAD

(71) Applicant: Airbus Operations SAS, Toulouse (FR)

(72) Inventor: Yann-Erick Lemonnier, Saint-Jean (FR)

(73) Assignee: Airbus Operations SAS, Toulouse (FR)

( * ) Notice: Subject to any disclaimer, the term of this patent is extended or adjusted under 35 U.S.C. 154(b) by 443 days.

(21) Appl. No.: 16/506,623

(22) Filed: Jul. 9, 2019

(65) Prior Publication Data

US 2020/0030871 A1 Jan. 30, 2020

(30) Foreign Application Priority Data

Jul. 25, 2018 (FR) ..... 1856894

(51) Int. Cl.

| | |
|---|---|
| ***B21J 15/10*** | (2006.01) |
| ***B21J 15/20*** | (2006.01) |
| ***B21J 15/28*** | (2006.01) |
| ***B21J 15/30*** | (2006.01) |
| ***B21J 15/02*** | (2006.01) |

(52) U.S. Cl.

CPC ..... *B21J 15/105* (2013.01); *B21J 15/02* (2013.01); *B21J 15/20* (2013.01); *B21J 15/285* (2013.01); *B21J 15/30* (2013.01)

(58) Field of Classification Search

CPC .. B21J 15/105; B21J 15/20; B21J 15/28–285; B21J 15/30

See application file for complete search history.

(56) References Cited

U.S. PATENT DOCUMENTS 2,169,423 A * 8/1939 Kessler ..... B21J 15/105 60/563
2,229,218 A * 1/1941 Meier ..... B21J 15/20 60/369

(Continued)

FOREIGN PATENT DOCUMENTS

DE 202016102595 U1 6/2016
EP 0107574 A1 5/1984

(Continued)

OTHER PUBLICATIONS

Translation of DE202016102595 (Year: 2016).*

*Primary Examiner* — Matthew P Travers
(74) *Attorney, Agent, or Firm* — Greer, Burns & Crain, Ltd.

(57) ABSTRACT

A portable tool comprising a hollow body delimiting two chambers and comprising a shoulder and a barrel extending from the shoulder. A piston slides in the chambers and a stem is secured to the piston and is accommodated in the barrel. A C-shaped head with a first end forms a shoe which presses against the shoulder and in which is created a bore into which the barrel fits, and with a second end facing the free end of the stem. A fastening system comprises a channel on the barrel perimeter. Two sliders are slidably mounted on the shoe parallel to a plane of movement which is perpendicular to the axis of the barrel. Each slider has an arc shaped face and movable between a retracted position in which the face is accommodated in the channel and an extended position in which the face is outside the channel.

4 Claims, 2 Drawing Sheets

(56) References Cited

U.S. PATENT DOCUMENTS

| | | | | |
|---|---|---|---|---|
| 2,365,538 | A * | 12/1944 | Fischer | B21J 15/22 72/432 |
| 3,581,373 | A * | 6/1971 | Murdoch et al. | B21J 15/02 29/243.54 |
| 7,313,852 | B2 | 1/2008 | Peckham et al. | |
| 2010/0000288 | A1* | 1/2010 | Barezzani | B21J 15/20 72/453.15 |
| 2012/0167366 | A1* | 7/2012 | Mauer | B21J 15/025 29/407.08 |
| 2014/0041193 | A1* | 2/2014 | Schlafhauser | B21J 15/285 29/432 |
| 2020/0147772 | A1* | 5/2020 | Frenken | B21D 28/34 |

FOREIGN PATENT DOCUMENTS

| | | | |
|---|---|---|---|
| EP | 2656943 | A2 | 10/2013 |
| FR | 2975025 | A1 | 11/2012 |

* cited by examiner

PORTABLE TOOL HAVING A REMOVABLE HEAD

CROSS-REFERENCES TO RELATED APPLICATIONS

This application claims the benefit of the French patent application No. 1856894 filed on Jul. 25, 2018, the entire disclosures of which are incorporated herein by way of reference.

FIELD OF THE INVENTION

The present invention relates to a portable tool comprising a removable head, and to a system using a portable tool of this kind.

BACKGROUND OF THE INVENTION

The installation of a rivet is done using a tool which comprises a jaw designed to upset the rivet. In order to adjust the jaw to the geometry of the parts that are to be assembled, it is desirable to be able to change the jaw.

Currently, changing the jaw is a relatively long and complicated process and must be carried out by a specialist technician.

SUMMARY OF THE INVENTION

One object of the present invention is to propose a portable tool which comprises an easily removable head.

To that end, there is provided a portable tool comprising:

a hollow body delimiting two chambers and comprising a shoulder and a barrel extending from the shoulder, an actuator comprising a piston that slides in the chambers and a stem that is secured to the piston and is accommodated in the barrel, a C-shaped head of which a first end forms a shoe which presses against the shoulder and in which is created a bore into which the barrel fits, and of which a second end faces the free end of the stem, and a fastening system comprising a channel created on the perimeter of the barrel, two sliders that are mounted so as to be able to slide on the shoe parallel to a plane of movement which is perpendicular to the axis of the barrel, where each slider has a face in the form of an arc of a circle and is able to move between a retracted position in which the face is accommodated in the channel and an extended position in which the face is outside the channel.

The head of a tool of this kind can therefore be quickly and easily removed and replaced as required, without the need for a specialist technician or tool.

Advantageously, the portable tool comprises a brake for each slider.

Advantageously, the brake is in the form of a ball mounted on a spring in the shoe, where the spring presses the ball against the slider.

Advantageously, the portable tool comprises an O-ring which is arranged in a channel around the barrel and which rubs against the surface of the bore of the shoe.

The invention also proposes a system comprising a portable tool according to one of the preceding variants and a hydraulic system comprising:

a control unit, and a hydraulic pressure generator which provides a hydraulic pressure to the portable tool at a first pressure and a second pressure greater than the first pressure, where the portable tool comprises a first button and a second button, where, when the first button is pressed, the control unit then controls the hydraulic pressure generator such that it delivers the fluid at a pressure equal to the first pressure, and where, when the second button is pressed, the control unit then controls the hydraulic pressure generator such that it delivers the fluid at a pressure equal to the second pressure.

BRIEF DESCRIPTION OF THE DRAWINGS

The features of the invention mentioned above, along with others, will become more clearly apparent on reading the following description of one exemplary embodiment, the description being given with reference to the appended drawings, in which.

DETAILED DESCRIPTION OF THE PREFERRED EMBODIMENTS

Figure 1:
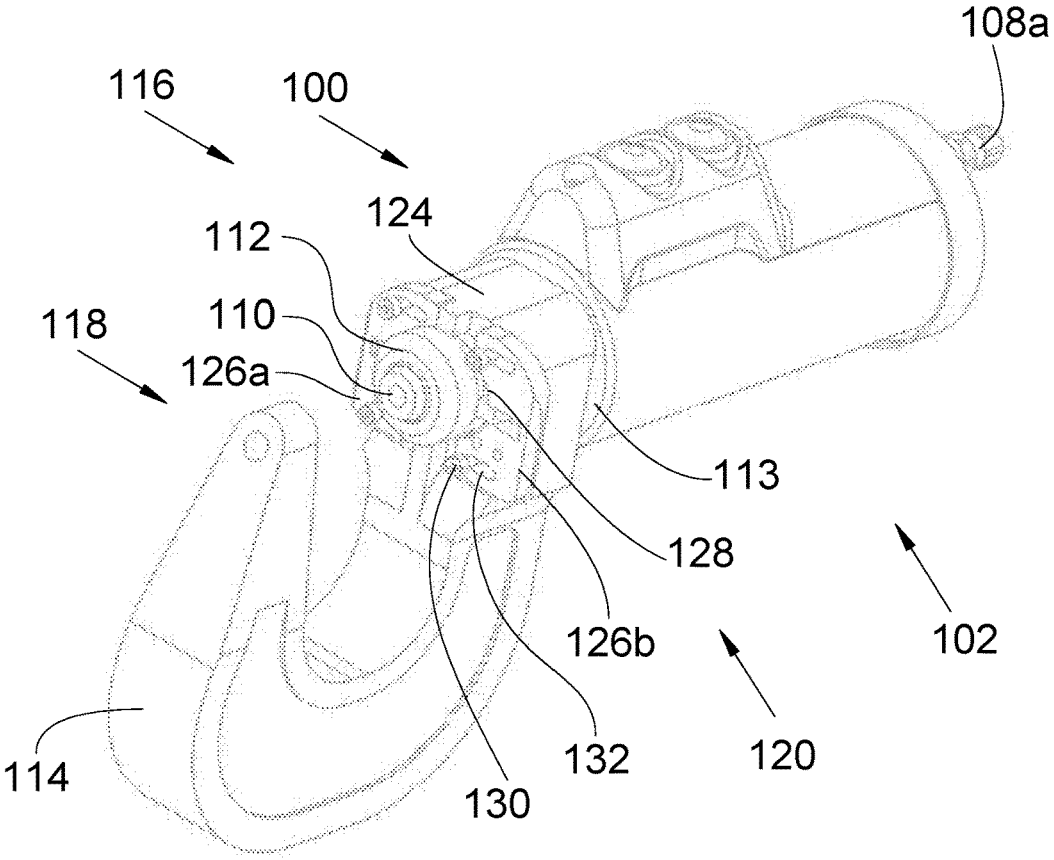
FIG. 1 represents a perspective view of a portable tool according to the invention.
Figure 2:
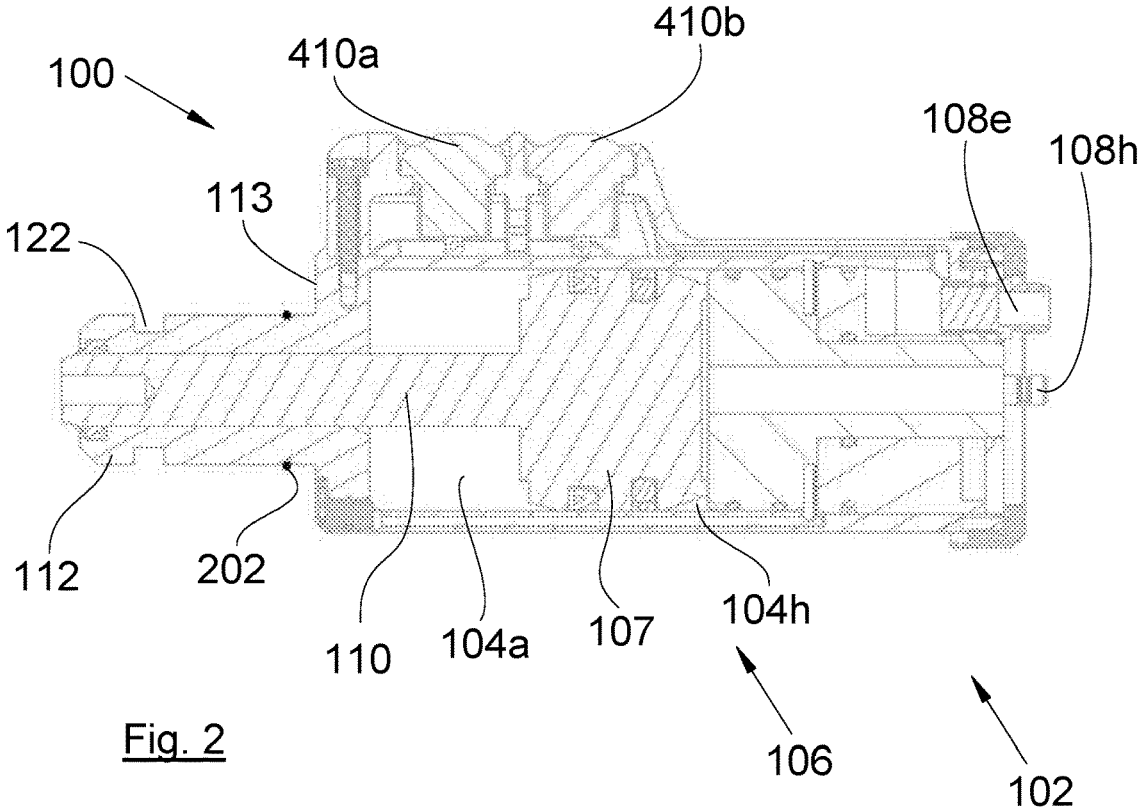
FIG. 2 shows a side view in section through the body of the tool of FIG. 1.

FIG. 1 shows a portable tool 100 according to the invention, which is configured in this case for installing rivets. FIG. 2 shows a section through the portable tool 100, along a median plane and without the head.

The portable tool 100 comprises a hollow body 102 delimiting two chambers 104*a*, 104*h* and an actuator 106 comprising a piston 107 that is mounted so as to be able to slide in the chambers 104*a*, 104*h*. The two chambers 104*a* and 104*h* are arranged on either side of the piston 107. As is conventional, the pressure difference between the two chambers 104*a*, 104*h* serves to move the piston 107 in one direction or the other.

The body 102 comprises a barrel 112 which extends outwards from a shoulder 113, and the actuator 106 has a stem 110 that is secured to the piston 107 and is accommodated in the barrel 112. Depending on the position of the piston 107 in the chambers 104*a* and 104*h*, the free end of the stem 110 protrudes from the barrel 112 to a greater or lesser extent.

In the embodiment of the invention shown in FIG. 2, the actuator 106 is hydraulically activated and, to that end, the body 102 comprises an inlet port 108*h* which communicates with the chamber 104*h*, which is opposite the stem 110 and which is configured to be connected to a hydraulic pressure generator.

The portable tool 100 also comprises a C-shaped head 114 of which a first end 116 forms a shoe 124 which has a bore into which the barrel 112 fits, and of which a second end 118 faces the free end of the stem 110. The second end 118 is in line with the stem 110. The shoe 124 presses against the shoulder 113.

Figures 3, 4:
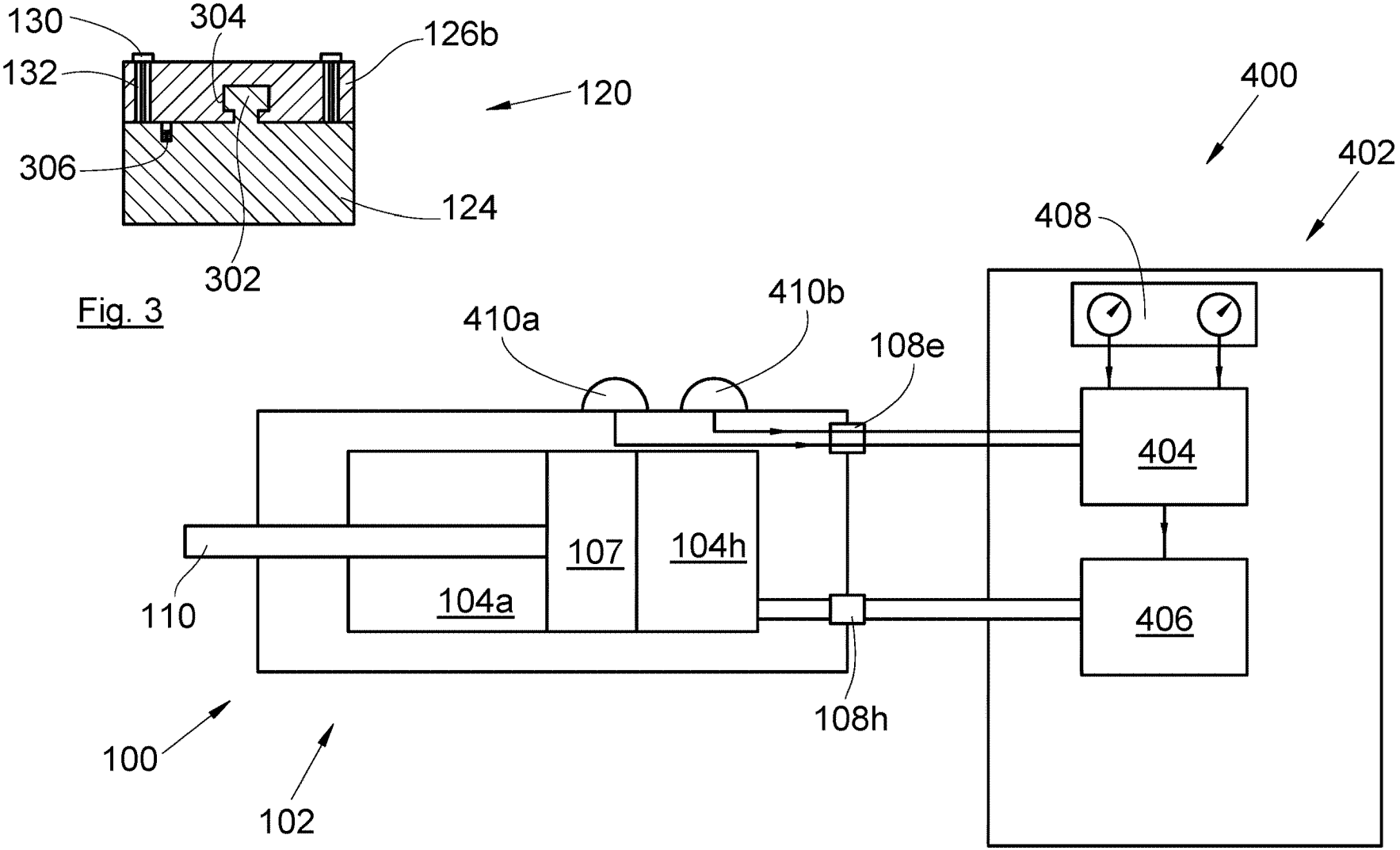
FIG. 3 is a side view in section through the head fastening system.
FIG. 4 is a schematic representation of a system using the portable tool according to the invention.

The portable tool 100 also comprises a fastening system 120, which is shown in section in FIG. 3 and which is intended for removably fastening the shoe 124 to the barrel 112.

The fastening system 120 comprises a channel 122 created on the perimeter of the barrel 112, and therefore coaxially with the axis of the barrel 112.

The fastening system 120 also comprises two sliders 126*a-b* that are mounted so as to be able to slide on the shoe 124 parallel to a plane of movement which is perpendicular to the axis of the barrel 112.

Each slider 126*a-b* has a face 128 in the form of an arc of a circle and is able to move between a retracted position and an extended position. In the retracted position, the face 128 is accommodated in the channel 122 and in the extended position, the face 128 is outside the channel 122.

Thus, in the retracted position, the shoe 124 is immobilized between the shoulder 113 and the channel 122 via the intermediary of the sliders 126*a-b*, and it is therefore secured to the body 102. In the extended position, the shoe 124 may be detached from the body 102 and the head 114 may be replaced with another head.

The operation of the portable tool 100 is then as follows: the rivet is placed at the second end 118 which is shaped so as to receive and hold the rivet, for example by virtue of having an appropriate hole or a rivet set, then the actuator 106 is activated to deploy the stem 110, the free end of which comes to upset the rivet in order to set it. The free end may comprise a rivet set.

Thus, installation and replacement of the head 114 are quick, easy and require neither a tool nor the aid of a specialist technician.

In order to guide each slider 126*a-b* in translation, the shoe 124 has a guiding rib 302 which fits into a guiding slot 304 of the slider 126*a-b*. In the embodiment of the invention shown in FIG. 3, the guiding rib 302 and the guiding slot 304 are both T-shaped, but other shapes are possible.

For each slider 126*a-b*, screws 130 are screwed into the shoe 124 through the slider 126*a-b* via openings 132 provided for that purpose. Here, the openings 132 are oblong in shape so as to aid the movement of the slider 126*a-b*. The screws 130 avoid loss of the slider 126*a-b*.

In order to avoid unintended movement of the sliders 126*a-b*, a brake 306 is provided for each slider 126*a-b*. In the embodiment of the invention shown in FIG. 3, the brake 306 is in the form of a ball mounted on a spring in the shoe 124, where the spring presses the ball against the slider 126*a-b* and ensures the stability of the position of the slider 126*a-b* in the retracted position and in the extended position.

In order to brake the rotation of the shoe 124 about the barrel 112, a rotation brake 202 is put in place. In this case, the rotation brake 202 is an O-ring which is arranged in a channel around the barrel 112 and which rubs against the surface of the bore of the shoe 124. The head 114 may thus adopt various positions about the axis of the barrel 112 and be held in these various positions, which makes the technician's work easier.

The free end of the stem 110 and the second end 118 are shaped so as to receive the rivet that is to be set, and may comprise rivet sets. However, the portable tool 100 may be used for other types of fastening. For example, it is possible to fasten a first jaw to the free end of the stem 110 and a second jaw at the second end 118, and after activation of the actuator 106, the first jaw approaches the second jaw so as to upset the part located between them. Depending on the type of jaw that is installed, it is then possible to carry out a drawing or swaging operation. It is also possible to carry out clinching, putting in place the necessary means at the free end of the stem 110 and at the second end 118.

FIG. 4 shows a system 400 using the portable tool 100 according to the invention.

The system 400 thus comprises the portable tool 100 and a hydraulic system 402.

The hydraulic system 402 comprises a control unit 404, a hydraulic pressure generator 406 which provides a hydraulic pressure to the portable tool 100 via the inlet port 108*h* and a control panel 408.

The hydraulic pressure generator 406 is able to deliver a fluid at at least two different operating pressures.

The control panel 408 may be a touch screen or buttons or other. It serves for adjusting the two operating pressures for the hydraulic pressure generator 406.

In the case of use for rivets, the first pressure corresponds to a pressure which serves to move the stem 110 so as to bring it into abutment against the second end 118 until in contact with the rivet, and the second pressure, greater than the first pressure, corresponds to a pressure which serves to exceed the elastic limit of the rivet so as to deform it plastically and perform a riveting operation.

The control unit 404 comprises, as is conventional, and connected by a communication bus: a processor or CPU (central processing unit); a random access memory (RAM); a read-only memory (ROM); a storage unit such as a hard disk or a storage medium reader, such as an SD (secure digital) card reader; at least one communication interface which, for example, allows the control unit 404 to communicate with the control panel 408 and the hydraulic pressure generator 406.

The processor is capable of executing instructions loaded into the RAM from the ROM, from an external memory (not shown), from a storage medium (such as an SD card), or from a communication network. When the equipment is powered up, the processor is capable of reading instructions from the RAM and executing them. These instructions form a computer program which causes the processor to implement all or some of the algorithms and steps described below.

All or some of the algorithms and steps described below may be implemented in software form through the execution of a set of instructions by a programmable machine, for example a DSP (digital signal processor) or a microcontroller, or be implemented in hardware form by a machine or a dedicated component, for example an FPGA (field-programmable gate array) or ASIC (application-specific integrated circuit).

The portable tool 100 comprises two buttons 410*a-b* and the control unit 404 communicates with these buttons 410*a-b* via the communication interface. To that end, an electrical connector 108*e* connected to the buttons 410*a-b* is provided on the body 102 in order to connect electrical conductors of the control unit 404.

The operation of the system 400 is then as follows:

- the technician sets the two operating pressures using the control panel 408 and thus defines the first pressure and the second pressure, which depend on the intended use for the portable tool 100, for example these values depend on the type of rivets used,
- the technician presses on the first button 410*a*,
- the control unit 404 then controls the hydraulic pressure generator 406 such that it delivers the fluid at a pressure equal to the first pressure,
- once the stem 110 has been brought into abutment, the technician presses on the second button 410*b*, keeping the first button 410*a* pressed,
- the control unit 404 then controls the hydraulic pressure generator 406 such that it delivers the fluid at a pressure equal to the second pressure, so as to deform, upset and set the rivet.

At the end of the process, the technician releases one or both buttons 410*a-b*, the control unit 404 then orders the hydraulic pressure generator 406 to cease delivering fluid under pressure. The stem 110 then retracts, for example under the action of a spring or by reversal of pressure in the actuator 106.

In this latter case, the portable tool 100 may comprise a return port 108*a* which communicates with the chamber 104*a* which is on the side of the stem 110 and which is connected to a pressurized air source. The lifting of the pressure in the chamber 104*h* and the pressurizing of the chamber 104*a* allows the piston 107 to return.

The hydraulic pressure generator 406 may be supplied by pneumatic, electric, hydraulic energy.

While at least one exemplary embodiment of the present invention(s) is disclosed herein, it should be understood that modifications, substitutions and alternatives may be apparent to one of ordinary skill in the art and can be made without departing from the scope of this disclosure. This disclosure is intended to cover any adaptations or variations of the exemplary embodiment(s). In addition, in this disclosure, the terms "comprise" or "comprising" do not exclude other elements or steps, the terms "a" or "one" do not exclude a plural number, and the term "or" means either or both. Furthermore, characteristics or steps which have been described may also be used in combination with other characteristics or steps and in any order unless the disclosure or context suggests otherwise. This disclosure hereby incorporates by reference the complete disclosure of any patent or application from which it claims benefit or priority.

The invention claimed is:

1. A portable tool comprising:

a hollow body delimiting two chambers and comprising a shoulder and a barrel extending from the shoulder, an actuator comprising a piston that slides in the chambers and a stem that is secured to the piston and is accommodated in the barrel, a C-shaped head of which a first end forms a shoe which presses against the shoulder and in which is created a bore into which the barrel fits, and of which a second end faces a free end of the stem, a fastening system comprising a channel created on a perimeter of the barrel, two sliders that are mounted so as to be able to slide on the shoe parallel to a plane of movement which is perpendicular to an axis of the barrel, where each slider has a face in the form of an arc of a circle and is able to move between a retracted position in which the face is accommodated in the channel and an extended position in which the face is outside the channel; and an O-ring arranged in a channel around the barrel and rubbing against a surface of the bore of the shoe.

2. The portable tool according to claim 1, further comprising a brake for each slider.

3. The portable tool according to claim 2, wherein the brake is in the form of a ball mounted on a spring in the shoe, where the spring presses the ball against the slider.

4. A system comprising a portable tool according to claim 1 and a hydraulic system comprising:

a control unit, and a hydraulic pressure generator which provides a hydraulic pressure to the portable tool at a first pressure and a second pressure greater than the first pressure, where the portable tool comprises a first button and a second button, where, when the first button is pressed, the control unit then controls the hydraulic pressure generator such that the hydraulic pressure generator delivers hydraulic fluid at a pressure equal to the first pressure, and where, when the second button is pressed, the control unit then controls the hydraulic pressure generator such that the hydraulic pressure generator delivers the hydraulic fluid at a pressure equal to the second pressure.

* * * * *